United States Patent [19]

Elsner et al.

[11] 4,347,021

[45] Aug. 31, 1982

[54] MINE ROOF SUPPORTS

[75] Inventors: Burckhardt Elsner, Lunen; Rüdiger Kirchbrücher, Dortmund-Brackel, both of Fed. Rep. of Germany

[73] Assignee: Gewerkschaft Eisenhutte Westfalia, Lunen, Fed. Rep. of Germany

[21] Appl. No.: 147,896

[22] Filed: May 8, 1980

[30] Foreign Application Priority Data

May 8, 1979 [DE] Fed. Rep. of Germany ..... 2918411
Oct. 18, 1979 [DE] Fed. Rep. of Germany ..... 2942093

[51] Int. Cl.[3] ..... E21D 17/054
[52] U.S. Cl. ..... 405/293; 405/291
[58] Field of Search ..... 405/293, 294, 295, 296, 405/291; 91/170 MP; 299/31, 33

[56] References Cited

U.S. PATENT DOCUMENTS 3,848,928 11/1974 Nakajima ..... 405/296 X

FOREIGN PATENT DOCUMENTS

| | | | |
|---|---|---|---|
| 1224249 | 9/1966 | Fed. Rep. of Germany | 405/293 |
| 2153496 | 6/1973 | Fed. Rep. of Germany | 405/293 |
| 1234662 | 6/1971 | United Kingdom | 405/294 |
| 1270115 | 4/1972 | United Kingdom . | |
| 665098 | 5/1979 | U.S.S.R. | 405/293 |

*Primary Examiner*—David H. Corbin
*Attorney, Agent, or Firm*—Sughrue, Mion, Zinn, Macpeak and Seas

[57] ABSTRACT

A mine roof support has a main roof bar which is pivotably connected to an auxiliary forwardly-extendible bar. A piston and cylinder unit serves to swing the auxiliary bar about the main bar to bring the auxiliary bar into a roof-contacting position aligned with the main bar or into a stowed position beneath the main bar or into some intermediate position. Pivotable guide members connect between the main and auxiliary bars respectively and a pivot joint linked to the piston and cylinder unit. The guide members can take the form of simple straps or levers but an additional piston and cylinder unit can also be used as one of the guide members.

14 Claims, 7 Drawing Figures

MINE ROOF SUPPORTS

BACKGROUND TO THE INVENTION

The present invention relates in general to mine roof supports and more particularly to roof-contacting structures of such supports which are provided with appliances for forwardly extending the structures. The term "roof-contacting structures" is intended to refer to simple bars or girders or to larger caps, linings or canopies which make contact with the roof of a mine working when the props of the support are extended.

It is known to provide the main roof-contacting structure e.g. a cap or bar, of a mine roof support with an auxiliary lining or structure which is pivotably connected thereto. A piston and cylinder unit can then be used to pivot the auxiliary roof-contacting structure about the main structure to bring the auxiliary structure into contact with the roof of the pertinent mine working. Other types of advanceable or forwardly extendible appliances cause the auxiliary structure to slide in or out relative to the main structure.

German patent specification No. 1230745 describes an appliance of the aforementioned kind wherein the piston and cylinder unit used to pivot the auxiliary bar is protected from the forces exerted by the roof on the auxiliary bar. The piston and cylinder unit is pivotably connected to an intermediate guide piece which is slidably mounted to the main bar and which connects to the auxiliary bar via a short pivotal strap. This known arrangement is apt to suffer from considerable wear, especially the slidable mounting of the intermediate guide piece, and is relatively costly to manufacture. In addition, the auxiliary bar can only be pivoted through a relatively small angle. In the event of excessive roof pressure, the auxiliary bar of this known arrangement is prone to suffer damage together with the associated guide components even if the piston and cylinder unit is itself protected by the self-locking action of the guide components. This self-locking action of the guide components also means that the portion of the roof in contact with the auxiliary bar is not always adequately supported since the piston and cylinder unit forms no part of the support.

A general object of this invention is to provide an improved form of extendible roof-contacting structure for a mine roof support.

BRIEF SUMMARY OF THE INVENTION

The invention provides a multi-part extendible roof-contacting structure which is composed of a main structure, an auxiliary structure pivotably connected to the main structure and an appliance or device for pivoting the auxiliary structure about the main structure to effect the extension as is known per se. In accordance with the invention, the auxiliary structure can now be pivoted about the main structure between an operative position aligned with the main structure and an inoperative position stowed beneath the main structure. The operating appliance or device which moves the auxiliary structure between these positions employs a piston and cylinder unit supported by the main structure and linked via pivotable guide members to both the main and auxiliary structures.

In one embodiment of the invention an extendible roof bar is composed of a main roof bar and an auxiliary roof bar, a pivot joint between the main and auxiliary roof bars, a piston and cylinder unit carried by the main bar and disposed therebeneath, a first guide member, a pivot joint connecting the first guide member to the auxiliary roof bar, a second guide member, a pivot joint connecting the second guide member to the main roof bar and means effecting a pivotal connection between the first and second guide members and the piston and cylinder unit, whereby the piston and cylinder unit can be extended and retracted to cause the auxiliary roof bar to swing about the pivot joint between the main and auxiliary roof bars to adopt an operative position aligned with the main roof bar and an inoperative position stowed beneath the main roof bar.

Unlike the arrangement discussed previously, the guide members do not produce a self-locking action and instead smoothly transmit the force of the piston and cylinder unit.

By selecting suitable lengths for the guide members, which can take the form of simple levers or straps, it is possible to obtain a mechanical advantage in respect of the force produced by the piston and cylinder unit. The auxiliary bar or equivalent can be neatly stowed beneath the main bar or equivalent and the total angle of pivoting of the auxiliary bar can be about 180°. The piston and cylinder unit holds the auxiliary bar in its set position and this unit can be locked hydraulically to maintain this set position. The unit can however be protected by a pressure-relief valve which opens should excess load become imposed on the auxiliary bar. In this way the guide members, auxiliary bar and the piston and cylinder unit can all be protected.

It is also possible to bring the auxiliary bar or equivalent into an intermediate position, say vertical, thus permitting the auxiliary bar to support a mineral face, if desired.

The mechanical linkage formed by the two guide members can be a unitary V-shaped component and forms a compact wear-resisting arrangement which transmits the forces with little frictional loss. A particularly simple construction results if the piston and cylinder unit is linked to the guide member via a common pivot joint and if this and the pivot joints linking the guide members to the main and auxiliary bars are arranged at the ends of the guide members. It is however, possible to link the unit to the guide members with separate pivot joints.

In a further embodiment of the invention the guide member connected to the auxiliary roof bar or equivalent takes the form of a second piston and cylinder unit. The pivot joint between the auxiliary bar and this second unit is conveniently near the front end of the auxiliary bar remote from the main bar while the other guide member is a short lever or strap. Both piston and cylinder units are then operated in unison to swing the auxiliary bar. With this construction it is necessary to offset the units transversally of the bars to ensure they can lie side-by-side when the auxiliary bar adopts its stowed position. The force necessary to move the auxiliary bar is shared by the units and pivoting angles in excess of 180° can be achieved. The units can be comparatively short and a particularly effective roof support force can be imparted to the forward auxiliary bar.

With larger roof contacting structures it is possible to utilize several devices or appliances each with a piston and cylinder unit and guide members as described arranged in side-by-side relationship across the structures.

The invention may be understood more readily, and various other features of the invention may become apparent, from consideration of the following description.

BRIEF DESCRIPTION OF DRAWINGS

Embodiments of the invention will now be described, by way of examples only, with reference to the accompanying drawings, wherein.

DESCRIPTION OF PREFERRED EMBODIMENTS

Figure 1:
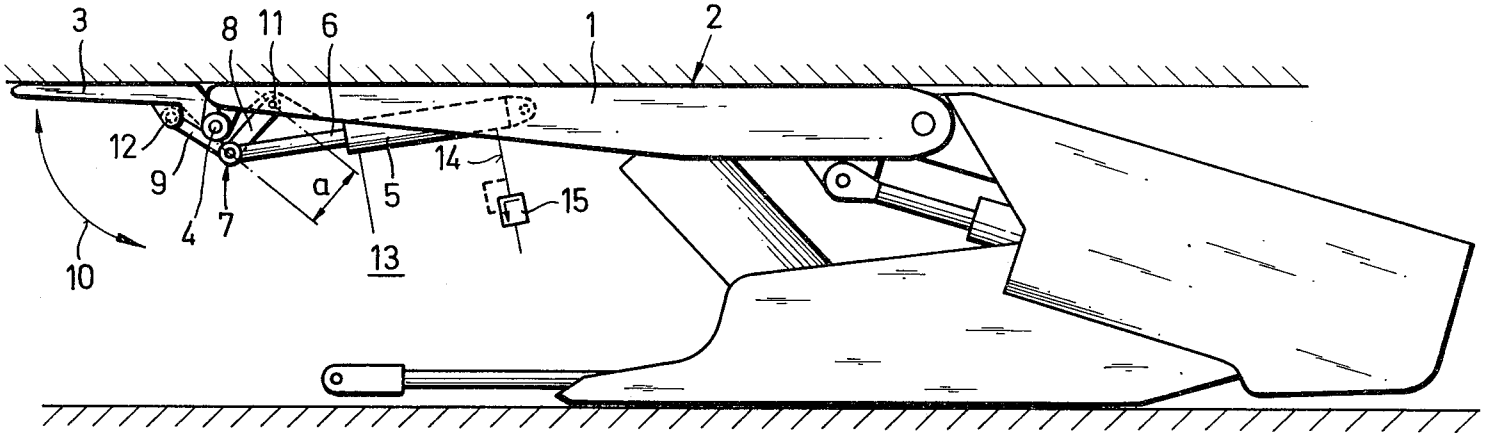
FIG. 1 is a schematic side view of a mine roof support provided with an extendible roof bar constructed in accordance with the invention.

Referring initially to FIG. 1, a roof support 2 of any known design is installed in a mine working. The support employs a main roof-contacting structure, such as a unitary roof bar 1, which is provided at its forward end, nearest the mineral face with an extension in the form of an auxiliary roof bar 3. An appliance or device shown in FIGS. 1 to 4 serves to move the roof bar 3 and with the aid of this device the roof bar 3 can be brought into an operating position aligned or coplanar with the main bar 1, as shown in FIG. 1.

Figure 2:
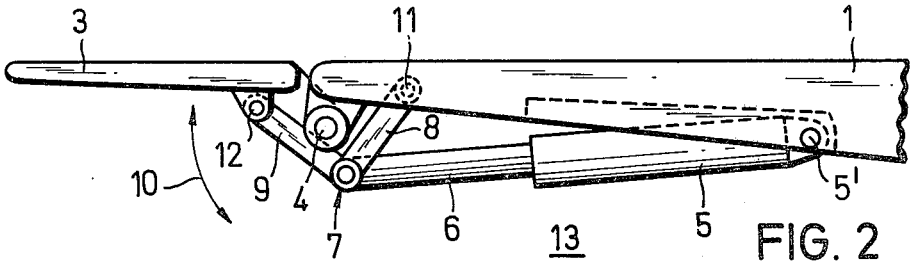
FIGS. 2 to 4 are side views of the roofbar of FIG. 1 in different operating positions, the views being taken on a somewhat larger scale than that adopted in FIG. 1.
Figure 3:
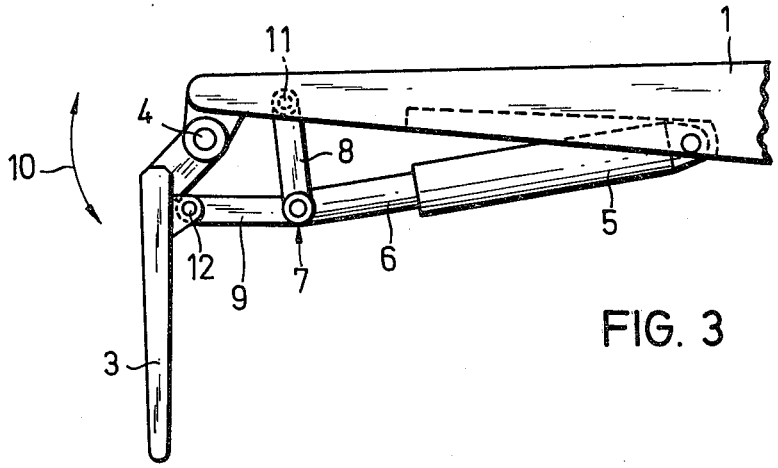
Figure 4:
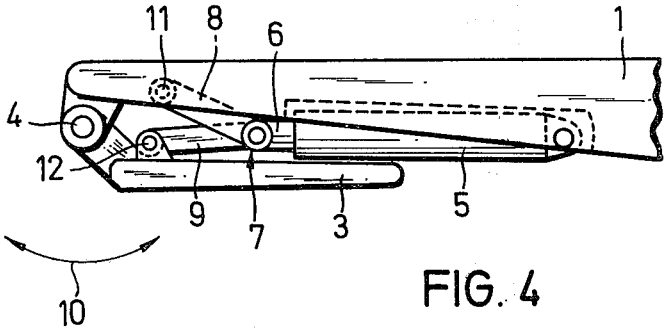

The auxiliary roof bar 3 is connected to the main roof bar 1 with a pivot joint 4 extending more or less parallel to the mineral face. The bar 3 can be swung about the joint 4 towards or away from the roof in the directions indicated at 10 in FIG. 1. The device for moving the bar 3 employs a double-acting piston and cylinder unit 5. The cylinder of this unit 5 is connected via a pivot joint 5' to the underside of the main bar 1, and the underside of the bar 1 is recessed to accomodate the cylinder of the unit 5. The piston rod 6 of the unit 5 is connected via a pivot joint 7 to guide members 8,9 in the form of simple straps or levers. The guide member 8 is connected at its end remote from the joint 7 to the underside of the main bar 1 via a further pivot joint 11 disposed near the joint 4 but rearwardly therefrom. The guide member 9 is connected at its end remote from the joint 7 to the underside of the bar 3 via a pivot joint 12. The pivot joints 7, 11, 12 extend parallel to the main pivot joint 4. FIGS. 2 to 4 show that as the unit 5 is operated to swing the bar 3 up or down the members 8,9 guide the bar 3 and transmit the motive force from the unit 5.

FIG. 2 shows the position adopted by the bar 3 when aligned with the main bar 1 in its operating position to form a forward extension thereof, while FIG. 4 shows the bar 3 in a fully inoperative collapsed position stowed safely beneath the main bar 1. In this stowed position the bar 3 does not appreciably intrude on the space 13 available beneath the bar 1. With the bar 3 set in the intermediate position depicted in FIG. 3 the bar 3 is more or less, vertical and this can perform a useful subsidiary function in preventing the mineral face from collapsing inwards. In moving between the operative and stowed positions (FIGS. 2 and 4) the bar 3 swings an angle of about 180°.

As represented in FIG. 1, the hydraulic pressure fluid supply 14 to the unit 5 incorporates a pressure-relief valve 15. Should the bar 3 encounter an excessive roof loading during use the valve 15 will open to permit the unit 5 to retract thereby to swing the bar 3 away from the roof. As also depicted in FIG. 1, the pivot joint 7 linking the guide members 8, 9 to the piston rod 6 of the unit 5 is located at a distance "a" from the joint 11 and the distance "a" may represent the length of the guide member 8.

Instead of inter-connecting the guide members 8,9 and the piston rod 6 to a common pivot joint 7, it is possible to utilize separate pivot joints between the guide members 8, 9 and between the piston rod 6 and the guide member 9. The pivot connections can also be made adjustable.

The linkage 8, 9 can enable the bar 3 to be moved with a mechanical advantage in relation to the stroke of the piston rod 6.

Figure 5:
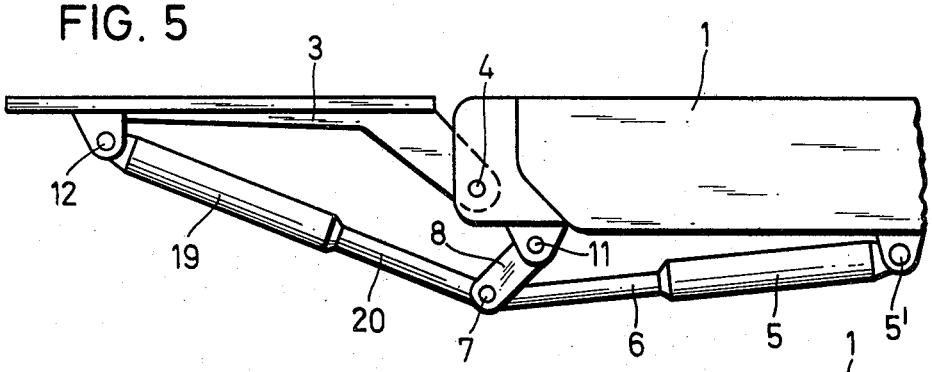
FIGS. 5 to 7 are side views of a modified form of the extendible roof bar in different operating positions, the views corresponding to FIGS. 2 to 4.
Figure 6:
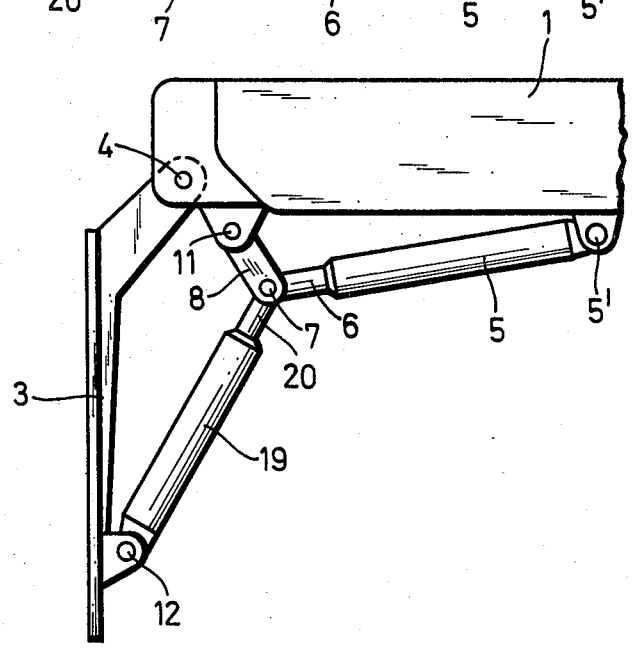
Figure 7:
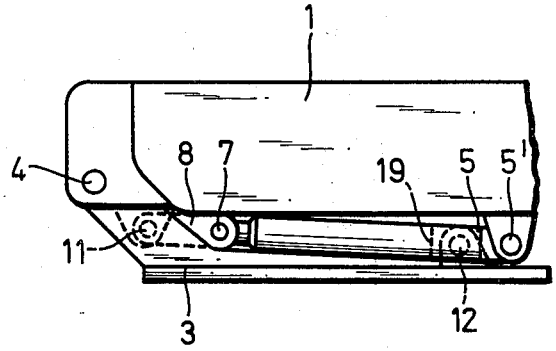

In the embodiment depicted in FIGS. 5 to 7, like reference numerals denote like parts to the embodiment represented in FIGS. 1 to 4 and described above. In contrast to the embodiment of FIGS. 1 to 4, the guide member 9 in the modified appliance of FIGS. 5 to 7 is replaced by a second piston and cylinder unit 19. The cylinder of this unit 19 is connected via the pivot joint 12 to the underside of the bar 3. The piston rod 20 of the unit 19 is connected to the guide member 8 and to the piston rod 6 of the unit 5 via the pivot joint 7. The pivot joint 12 is located near the forward end of the bar 3 and the guide member 8 is somewhat shorter than the equivalent member in the embodiment of FIGS. 1 to 4. The bar 3 is swung towards or away from the roof by operating both the units 5, 19 together. It is possible to swing the bar 3 through an angle in excess of 180°. FIG. 5 depicts the bar 3 in its roof-contacting position aligned with the main bar 1. In this position both the units 5, 19 are extended. By retracting the units 5, 19 the bar 3 can be moved into its inoperative position stowed beneath the bar 1 as shown in FIG. 7. The units 5, 19 are laterally offset from one another so that in the stowed position of the bar 3, the units 5, 19 extend approximately parallel to one another in side-by-side relationship. It is possible to bring the bar 6 into any intermediate supported position by partial extension or retraction of the units 5, 19. Thus, FIG. 6 shows the bar 3 in a vertical position which enables the mineral face to be supported with a considerable restraining force.

The hydraulic control system for operating the units 5, 19 can be quite simple since the units 5, 19 can be operated together either in extension or retraction. Pressure-relief for safety purposes can be adopted as described previously.

We claim:

1. In or for a mine roof support, a multi-part extendible upper roof contacting structure composed of a main roof-contacting structure, an auxiliary roof-contacting structure pivotably connected to the main structure, an appliance for pivoting the auxiliary structure about the main structure, and linkage means for enabling the appliance to adjust the position of the auxiliary structure between limiting positions aligned with the main structure and stowed beneath the main structure, said appliance comprising a piston and cylinder unit carried by the main structure and disposed therebeneath, and the linkage means comprising a first guide member pivotably connected to the auxiliary structure, a second guide member pivotably connected to the main structure, and means pivotably connecting the guide members to the piston and cylinder unit.

2. A structure according to claim 1, wherein the piston and cylinder unit can be locked hydraulically to hold the auxiliary structure in position relative to the main structure.

3. A structure according to claim 1, wherein the means pivotably connecting the guide members to the piston and cylinder unit comprises a common pivot joint.

4. A structure according to claim 1, wherein the guide members are formed as a unitary component.

5. A structure according to claim 1, wherein the guide members are levers.

6. A structure according to claim 1, wherein the first guide member pivotably connected to the auxiliary structure takes the form of a further piston and cylinder unit.

7. A structure according to claim 1, wherein the auxiliary structure sweeps through an angle of at least 180° in moving between the limiting positions.

8. A mine roof support provided with an extendible roof bar composed of a main roof-engageable bar and an auxiliary roof-engageable bar, a first pivot joint between the main and auxiliary roof bars, a piston and cylinder unit carried by the main bar and disposed therebeneath, and guide means linking the piston and cylinder unit to the main and auxiliary roof bars to enable the piston and cylinder unit to swing the auxiliary roof bar between a position aligned with the main roof bar and a position stowed beneath the main roof bar and to hold the auxiliary roof bar in any desired intermediate position; the guide means comprising a first guide member, a second pivot joint connecting the first guide member to the auxiliary roof bar, a second guide member, a third pivot joint connecting the second guide member to the main roof bar, at least one of the second and third pivot joints being disposed closer to the roof-engageable surface of the associated main or auxiliary structure than the first pivot joint, and means effecting a further pivotable connection between the first and second guide members and the piston and cylinder unit.

9. A roof support according to claim 8, wherein the means effecting a further pivotable connection between the guide members and the piston and cylinder unit takes the form of a common pivot joint.

10. A roof support according to claim 8, wherein the guide members are levers.

11. A roof support according to claim 8, wherein the first guide member takes the form of a further piston and cylinder unit.

12. A roof support according to claim 11, wherein the second pivot joint connecting the further piston and cylinder unit to the auxiliary roof bar is disposed near the front end of the latter remote from the first pivot joint between the main and auxiliary roof bars.

13. A roof support according to claim 11, wherein the further piston and cylinder unit is offset from the first-mentioned unit transversally of the auxiliary and main roof bars so that the piston and cylinder units can locate in side-by-side relationship when the auxiliary roof bar adopts its stowed position.

14. A roof support according to claim 8, wherein the auxiliary roof bar swings through an angle at least 180° in moving between the aligned and stowed positions.

* * * * *